United States Patent [19]

Allen

[11] Patent Number: 4,467,938

[45] Date of Patent: Aug. 28, 1984

[54] CLOSURE-OPENING DEVICE

[75] Inventor: David O. Allen, Wilmington, Ohio

[73] Assignee: Allen Tool Company, Inc., Wilmington, Ohio

[21] Appl. No.: 526,355

[22] Filed: Aug. 25, 1983

[51] Int. Cl.[3] ..... B65D 17/34

[52] U.S. Cl. ..... 220/270

[58] Field of Search ..... 220/268, 270, 276

[56] References Cited

U.S. PATENT DOCUMENTS 4,210,618 7/1980 Piltz et al. ..... 220/270

4,360,121 11/1982 Helms ..... 220/270

*Primary Examiner*—George T. Hall

*Attorney, Agent, or Firm*—Becker & Becker, Inc.

[57] ABSTRACT

A closure-opening device for a 360° peripherally-scored lid closure member including an "arrow-tab" element having a base portion, middle portion and a head portion. A tab-score extends around the "arrow-tab" element and terminates at opposite ends of the tab score at opposite locations adjacent to an underside of the base portion. The head portion has a sharp included-angle point of approximately 60° angle and the base portion has a relatively blunt included-angle point of approximately 120° angle. Reinforcement droplet portions are located in a spaced pair at opposite ends of the tab score. Fingernail engagement projections extend laterally outward from the sharp angle head portion of the tab element. The middle portion has finger-graspable arcuate-shaped recesses on opposite side walls thereof. The "arrow-tab" element projects upwardly and a stress concentrated for initial rupture of the tab score is provided at the sharp included-angle point while the reinforcement droplet portions preclude any complete separation of the tab element from ever occurring as to the lid closure member. A further raised-surface, upwardly-extending arrow-shaped tab element is provided in a location substantially diametrically opposite to the tab element located substantially radially in the panel portion; the further tab element has an enlarged elliptical base and a further tab score extending completely around the periphery of the further tab element completely removable from the panel portion to have a pour-spout opening surrounded by a pour-spout lip crescent-shaped like a "C" in a location intermediate the peripheral rim and the pour-spout opening.

16 Claims, 9 Drawing Figures

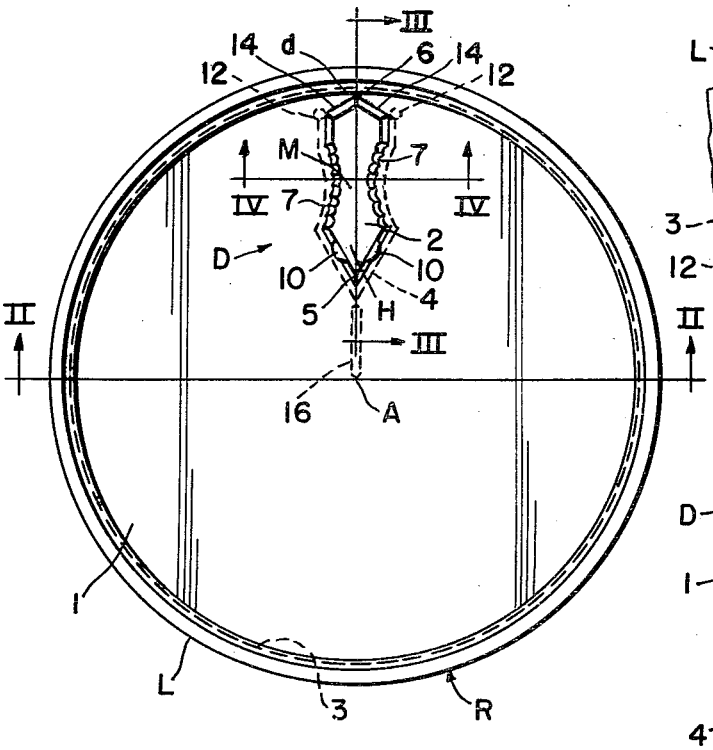
FIG-5
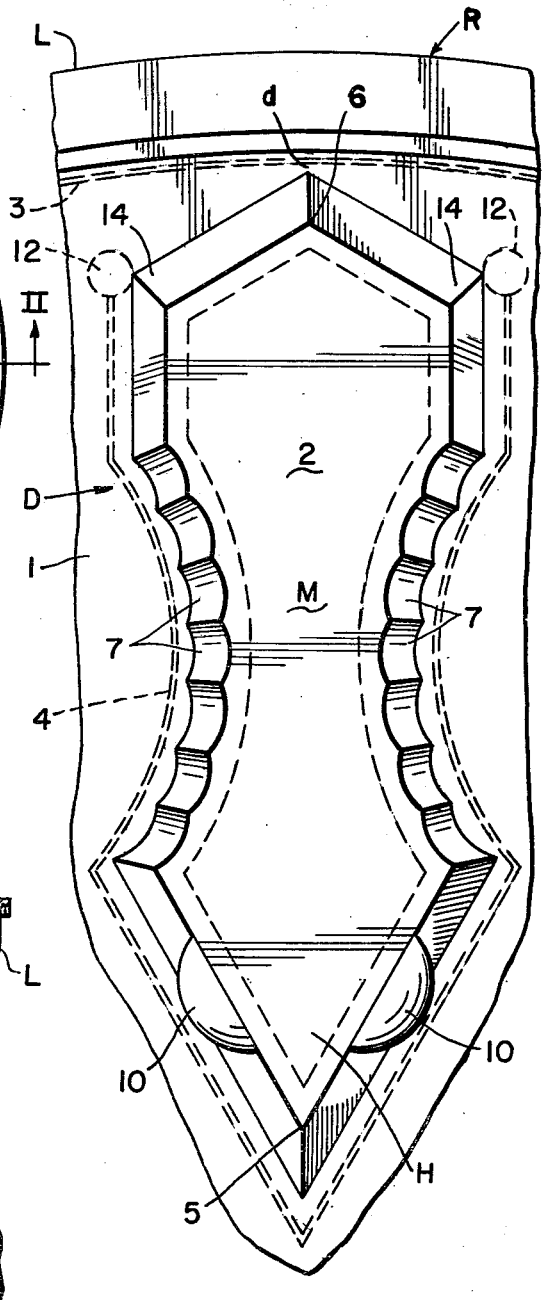
FIG-2
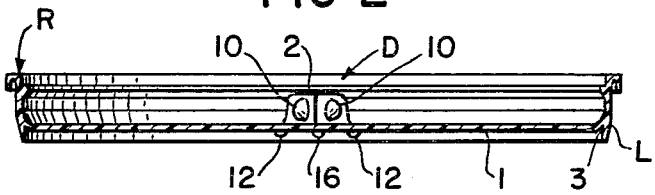
FIG-5A
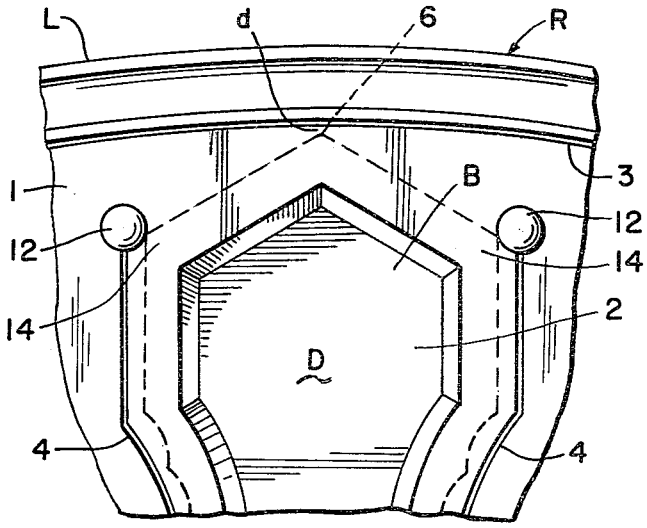

CLOSURE-OPENING DEVICE

The present invention relates to a container and closure assembly to purvey edible products or substances capable of being dispensed therefrom in a readily accessible manner.

BACKGROUND OF THE INVENTION

1. Field of the Invention

Shelves in food stores are stocked with containers for liquid, shortening, lard, shelled peanuts, granular or freeze-dried or instant coffee, bread crumbs, powdered milk, salt and other granular, coarse, as well as flake particles used by consumers, subject to resealing or repeated opening and closing of the container. Such containers include a body of composite structure including a molded plastic closure adhesively attached thereto and usually having a plastic over-closure or flexible lid to reseal the container or package after opening thereof, including those subject to resealing or repeated opening and closing of the container.

2. Description of the Prior Art

U.S. Pat. No. 4,030,630—Yearly dated June 21, 1977 provides an all plastic reclosable container presently found in some food stores and having a lid with a disc-shaped flat-panel central section and a peripheral crescent-shaped or spiral tear strip pushable and/or pullable to allow opening thereof along a first score line that surrounds the flat panel section and a second score line that merges with the first at a particular location and then follow a path essentially concentric to the circumferential score for approximately 180 degrees of arc. This forms a tear strip that allows the container to be opened by pressing down on an end of the tear strip near the location where the score lines merge to rupture the scoring at the end of the tear strip. A finger can then enter the container to grasp the end of the tear strip and lift upward, tearing along the two score lines until an end of the secondary score is reached, and then following along the remainder of the circumferential score line until the panel of the closure is completely removed. The closure of this type has some potential drawbacks including: (a) the force required for the initial rupture at the end of the tear strip is relatively high, due to the lack of an effective concentration of stress at a particular point along the score lines; (b) to grasp the end of the tear strip after initial rupture, the finger must enter the container, which may be objectionable with certain container contents; (c) as the closure panel is completely torn away, the tear strip is in a position to act as a spring and, if the container held liquid or powdery contents, then any liquid or powdery contents remaining on the bottom of the closure panel could be flicked on the person opening the package; (d) the position of the secondary score line can cause molding problems if the closure cavity of the mold is center gated as desirable for multi-cavity molds designed for high production rates. Optionally, U.S. Pat. No. 4,030,630 discloses an upwardly-extending cantilever-projecting tab element used to aid the removal of the closure panel similar to a lift tab of an expired U.S. Pat. No. 2,383,274—Punte dated Aug. 21, 1945. U.S. Pat. No. 3,434,620—Laurizio dated Mar. 25, 1969 shows an annular finger loop to aid in lifting a frangible plastic closure. U.S. Pat. No. 4,331,256—Helms dated May 25, 1982 has a dispensing arrangement for a composite plastic and paperboard lid with a relatively thin paperboard central panel and an annular molded plastic rim including an arrow-shaped tab pivotally mounted on a bar for forcing a portion of the paperboard away from the plastic rim to provide a dispensing opening. U.S. Pat. No. 4,256,239—Yamaguchi et al dated Mar. 17, 1981 provides a pair of tongue-shaped strips to define a stress-concentrated point upon a thinned portion therebetween that is first sheared off. U.S. Pat. No. 3,863,801—Pillnik dated Feb. 4, 1975 has a camber and stress tab handle portion which will not rise above a top portion of a double seam of a can end closure. A popcorn package of expired U.S. Pat. No. 3,144,194—Cartwright dated Aug. 11, 1964 has a pan-shaped receptacle and a cover panel provided with circular cut score lines spaced from each other to define a tab adapted to be pressed and lifted for access to package contents. Expired U.S. Pat. No. 3,245,576—Griese has a container cover with a radially upwardly projecting tab along an edge thereof. A foreign Swedish Pat. No. 203,587—Andrea et al published Apr. 19, 1966 has a metal can lid with a radially pointed and embossed arrow tab member pivotable upwardly for access to can contents. U.S. Pat. No. Des. 248,376—Allen et al dated July 4, 1978 shows a flanged closure with a tear strip, and other prior art exists having rib disc closures and tear strips including U.S. Pat. Nos. 4,066,181—Robinson et al dated Jan. 3, 1978; 4,066,182—Allen et al dated Jan. 3, 1978; Des. 248,216—Allen et al dated June 20, 1978; Des. 248,217—Allen et al dated June 20, 1978; Des. 248,373—Allen dated July 4, 1978; 4,117,950—Allen dated Oct. 3, 1978; as well as U.S. Pat. Nos. 4,128,385—Allen dated Dec. 5, 1978 for a cross-gating apparatus and 4,128,613—Allen dated Dec. 5, 1978 for a cross-gating method.

SUMMARY OF THE INVENTION

An object of the present invention is to provide an "Arrow-Tab" closure-opening device having a center position of a molding gate as desirable in multi-cavity molds for high production rates and including a radially inwardly pointing, upwardly raised tab element along opposite sides of a V-shaped radially inner end thereof including lateral ledge projections for finger or fingernail engagement to lift a point of the "Arrow-Tab" element after initial rupture and optionally also including an intermediate body portion of the "Arrow-Tab" element with a plurality of arcuate scoops or scallops along opposite sides to enhance finger gripping action relative thereto.

Another object of the present invention is to provide a radially outwardly located base portion of an "Arrow-Tab" element of a closure-opening device joined positively to a 360° peripherally-scored lid closure member lifted thereby and including a pair of spaced semi-spherical downward extending corner reinforcements to preclude any unwanted corner tearing out when lifting the tab element to open the closure member. Also, a further object is to provide a downwardly-projecting, radially-outwardly extending radial rib or bar located at least partially to one side of a center position of a mold gate desirable in multi-cavity molds for high production rates.

This object, and other objects and advantages of the present invention, will appear more clearly from the following specification in connection with the accompanying drawings.

BRIEF DESCRIPTION OF THE DRAWINGS

FIG. 1 is a top view of a closure for a container having a closure-opening device with features according to the present invention;

FIG. 2 is a cross-sectional elevational view taken along line II—II in FIG. 1;

FIG. 5 is an enlarged top view of a closure-opening device having features according to the present invention;

FIG. 5A is an enlarged fragmentary bottom view of the closure-opening device of FIG. 5;

DESCRIPTION OF PREFERRED EMBODIMENT

Figure 3:
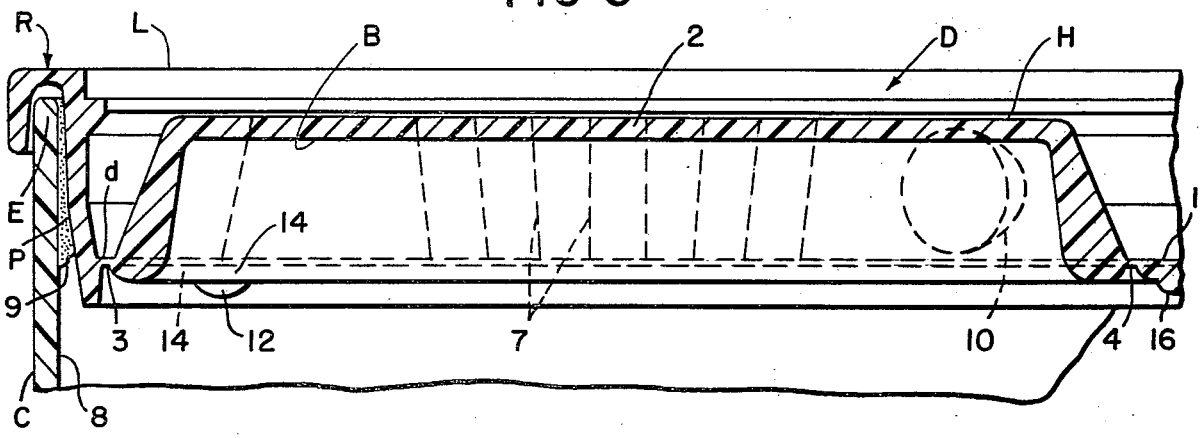
FIG. 3 is an enlarged cross-sectional elevational view taken along line III—III in FIG. 1.
Figure 4:
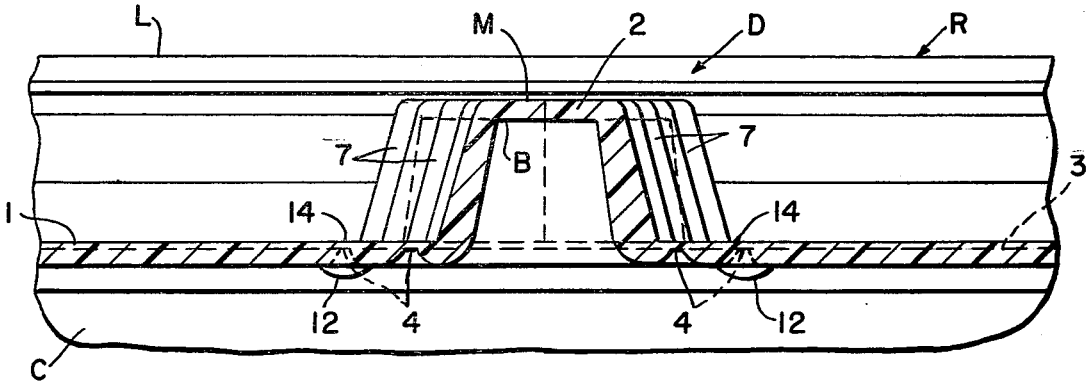
FIG. 4 is a cross-sectional elevational view taken along line IV—IV in FIG. 1.
Figure 6:
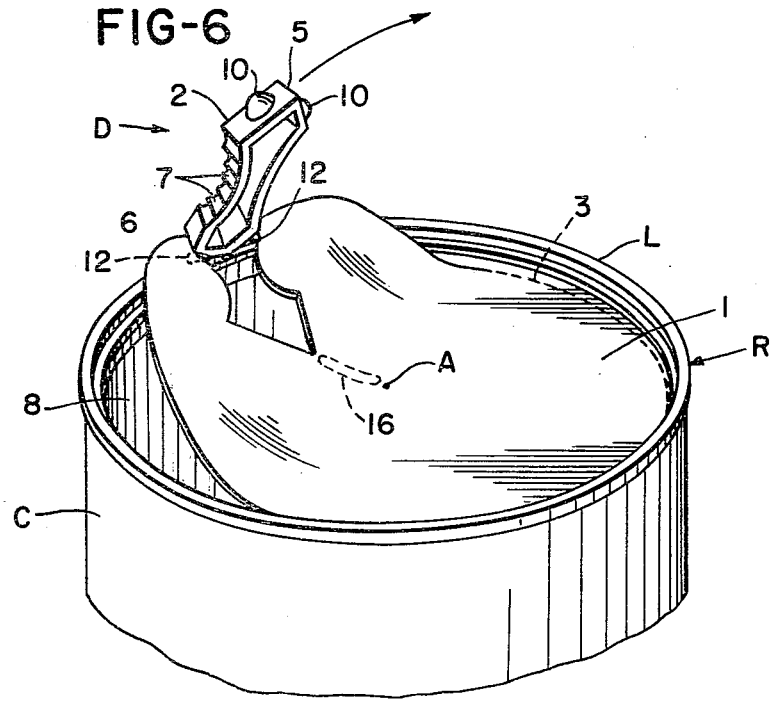
FIG. 6 is a fragmentary perspective elevational view illustrating the opening of a container having a closure-opening device with features according to the present invention.

Referring now to the drawings in detail, FIGS. 1 through 8 inclusive show a closure-opening device D of a cover or lid L for a container C. The lid L and closure-opening device D form part of a container and closure assembly, the closure of which is molded of a thermoplastic material, such as low-density polyethylene, linear polyethylene or other, suitable moldable plastic material, and having a closure panel surface 1; a raised surface or upwardly-extending arrow-shaped portion or tab element 2; a molded-in score-line or thinned-area portion including a circumferential score 3 and a tab score 4. The closure lid L includes a peripheral rim R which fits complementary to an upper peripheral edge E of the container C according to FIG. 3.

The arrow-shaped closure-opening device D is molded integrally with the lid L and tip of the arrow-shaped configuration points radially inwardly to a center location or axis A of the lid; a 60-degree included-angle point 5 as well as a 120-degree included-angle point 6 at a radially-outwardly located end or base B of the arrow-shaped tab element 2. The angle point 6 terminates closely adjacent to, though spaced, a short distance d radially inwardly of the rim R as apparent in FIGS. 1,3 and 5 of the drawings.

The closure-opening device D has a plurality of arcuate scoops, scallops, curved or serrated side recesses 7 located along opposite side walls of a middle reduced-width or median neck portion M of the closure-opening device D.

Between an inner side wall 8 of the container C and a substantially cylindrical portion or periphery P of the rim R there is applied an adhesive 9 as shown in FIG. 3 to hold the cover or lid L sealed securely to the container C. An initial rupture of the tab score 4 is undertaken by pressing down on the raised surface of the tab element 2. As an aid for lifting the arrow-shaped tab element 2, lateral projections 10 semi-circular in shape are provided on opposite side walls of arrow head H to facilitate manual engagement and grasping there for lifting purposes by fingertips or fingernails engaging the lateral projections 10.

Combination of the lateral projections 10, as well as the plurality of arcuate scoops, scallops, curved or serrated side recess 7 located along opposite side walls of the middle reduced-width or median neck portion M of the closure-opening device D facilitates and expedites employment thereof in rupturing the circumferential score 3 at least partially for access to contents of the container C and for complete removal of the lid L therefrom by 360° circumferential rupturing or tearing open along the circumferential score 3. A snap-fit overclosure or over-cap (not shown) of plain plastic for reclosing of the container can be provided to fit tightly and sealingly over the rim R secured by adhesive 9 to the annular end E of the container C.

As a protection against excessive tear or rupture of the tab score 4 in substantially radially, outermost locations thereof, added semi-spherical droplets or rivet-shaped reinforcement portions 12 are provided as molded at opposite corner ends 14 of the bottom or base B of the arrow-shaped closure-opening device D. These reinforcement portions 12 are molded in spaced, paired relationship at opposite ends of the tab score 4 so that the base B of the arrow-shaped tab element 2 always remains securely attached to the lid L and a complete tearing-out or separation of the arrow-shaped tab element 2 from the lid L is precluded thereby so that free pivotal up-and-down movement of the tab element 2 is possible once the initial rupturing of the tab score 4 has occurred. The radially outer end of the base or bottom B of the arrow-shaped tab element is close to the circumferential score 3.

A radial rib or bar 16, for stiffening and/or stacking, is molded extending radially intermediate the tip or point 5 and center axis A along an underside of the lid. This bar 16 from the tip of the arrow to the center of the lid L is the result of a molding runner channel to the tab score 4. Such center position of the mold gate at the axis A is usually desirable in multi-cavity molds designed for high production rates. The position of the secondary score line of the U.S. Pat. No. 4,030,630 can cause molding problems if the closure cavity of the mold is center gated. This is due to the fact that the raised area in the cavity or core that forms the score line interferes with the radial flow of molten plastic from the gate along approximately 180 degrees of its length, creating an imbalance in filling the cavity. The circumferential score on the other hand creates no particular problem because it is placed at a constant distance from the gate, and is a full 360 degrees in length.

The present invention provides improvements to take into account any of these possible problems in the following manner:

Item 1. The 60 degree included-angle point at the end of the raised area should provide good stress concentration for easy initial rupture, while the 120 degree included-angle point at the opposite end, along with other leverage principles incorporated in the design, should facilitate easy rupture of the circumferential score.

Item 2. When the initial rupture is accomplished, the raised portion of the closure panel will return to near its original position, due to its rigid shape. The serrated curved sides of the raised area can then be grasped by the fingers without the need for the fingers to enter the container.

Item 3. The flipping action inherent in tearing out a closure panel incorporating a tear strip score design, would be greatly reduced by elimination of the strip.

Item 4. The elimination of the 180 degrees of secondary score line will greatly facilitate mold filling from a center placed gate. Although the scoring around the raised surface would present some obstruction to material flow, the fact that this scoring does not merge with the circumferential score greatly improves the mold filling pattern. The material flowing into the cavity from a center gate would tend to be divided when it encounters the 60-degree included-angle point, and flow along the outside of these score lines until it reaches the ends of these score lines. The material is then free to flow together and fill the raised area, passing between the ends of these score lines, and join with whatever material that has passed over the mold scores during mold fill.

The closure described by the drawings is basically a full center pull-out type, molded of low density polyethylene, and adhesively attached to the inside diameter of a paper board/aluminum foil spiral wound composite can or tube, with a double seamed metal end on the bottom.

Other possible applications would include:

1. A closure of the same basic design adhesively attached to the outside diameter of a composite can rather than the inside.

2. A closure of the same basic design but having no circumferential score. This version would be intended for containers with liquid contents, and the raised area would be completely torn away leaving a self-venting type of pour opening in the closure panel.

3. A molded one-piece version which would eliminate the composite can. The closure and container side walls would be molded as one piece, and either a plastic bottom adhesively or otherwise attached or a metal bottom applied in a double seaming operation to complete the package.

In summary, the present invention concerns a container and closure assembly, the closure of which is molded of a thermoplastic material such as low density polyethylene and having a molded-in score line or thinned area that coincides generally with respect to the inside diameter of the container. The score line provides a weakened area to allow the center panel of the closure to be torn away from the container and closure assembly to provide access to the contents therein.

The center panel of the closure is generally flat except for a raised portion at a location radially adjacent the circular score line. This raised portion has wall sections that are essentially vertical to the closure panel, and a top wall section that is parallel to the panel section. The vertical wall sections define an elongated shape that is pointed on each end, the sides of which c curve inward so that the elongated shape is narrowest in cross-section at a point near its midsection. The pointed end of the raised portion nearest the center of the closure panel forms an acute angle of approximately 60 degrees included angle, while the pointed end adjacent the circumferential score line forms an included angle of approximately 120 degrees.

A second score line or weakened area partially surrounds the raised area, beginning at the point of the 60-degree included angle, and following the contour along each side of the vertical walls, ending at points near the outer circumference of the removable panel section. The exterior of the curved portions of the vertical walls of the raised area are provided with serrations to provide a gripping surface.

To open a container incorporating a closure of this design, finger pressure is applied at a point near the 60-degree included-angle end of the raised area causing stress to be concentrated at the point where the score lines partially surrounding the raised area begin. This stress will cause the score line to rupture at this point, and the tear thus initiated will follow along each side of the vertical wall sections as pressure application is continued, until the ends of the score lines are reached. Thus the raised portion will be forced downward into the container until the top wall of the raised area near the 60-degree included-angle end is essentially flush with the closure panel surface. When finger pressure is released, the raised area will spring back to near its original position.

The raised area is thus separated from the panel surface except for attachments remaining along the 120-degree included-angle end. The serrated curved sides of the raised area can now be grasped with the fingers and lifted upward. As the raised area is pivoted upward, stress is concentrated at the point of the 120-degree included angle which is nearly tangent to the circumferential score line surrounding the panel area. This concentrated stress will cause rupture of this score line at that point, and the tear thus initiated will continue in two directions from this point following the circumferential score line, until the entire panel of the closure is removed.

Figure 7:
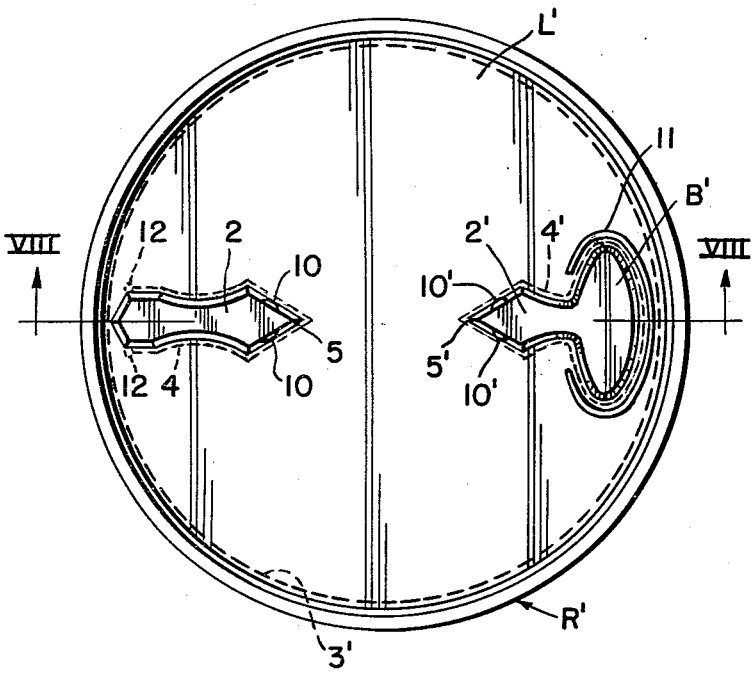
FIG. 7 is a plan view showing modifications to include a diametrically opposite second arrow-tab element with a pour spout lip.
Figure 8:
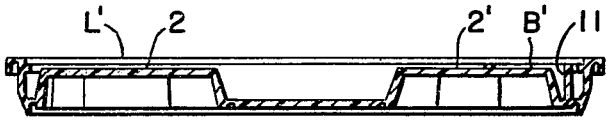
FIG. 8 is a cross-sectional elevational view taken along line VIII—VIII in FIG. 7.

FIGS. 7 and 8 show further features in accordance with the present invention including particularly another possible application beyond a previously mentioned closure described with no circumferential score, but having a score around the entire periphery of the raised arrow tab element. An opening that remains when the arrow-tab element is torn away is described as being a self-venting opening for pouring of liquid contents.

For many dry granular or powdery products, such as "Wyler" or "Kool-Aid" type drink mixes, a pouring opening may be desirable for convenience of use. Further, a second arrow-tab element 2' removable to provide an opening or pour spout can be added to the lid or cover L' directly diametrically opposite the arrow-tab element 2. This assures the consumer an added opportunity of opening the pour spout and pouring the contents of a container into a measuring cup prior to mixing with water, or removing the entire top and dipping a measuring cup or spoon into the contents of a can or container as is otherwise done. Similar or identical structures in FIGS. 7 and 8 have primes added to corresponding reference numeral designations. An enlarged elliptical base or bottom B' can be provided along with a pour spout lip 11 at least partially and peripherally surrounding a pour opening which results after removal of the arrow-tab element 2' and which is arcuate or crescent-shaped, extending upwardly like a "C", in a location intermediate the peripheral rim and the pour opening.

The present invention is, of course, in no way restricted to the specific disclosure of the specification and drawings, but also encompasses any modifications within the scope of the appended claims.

I claim:

1. A closure-opening device for a container having side wall configuration and a closed bottom as well as a top capable of being opened for access to contents thereof including, for example, liquid, lard, shortening, shelled peanuts, granular or freeze dried or instant coffee, bread crumbs, powdered milk, salt, and other granular, coarse, as well as flake particles used by consumers, comprising:

a molded plastic closure member having a rim portion and a substantially flat surface panel portion;

a molded-in thinned-area portion including a circumferential score-line between the rim portion and the panel portion;

a raised surface, upwardly extending arrow-shaped tab element located substantially radially in the panel portion and also having a tab score around periphery of said tab element though terminating at opposite ends of the tab score at a pair of locations spaced inwardly a short distance from the circumferential score line on either side of said tab element;

a first included-angle point provided with said tab element and positioned radially inwardly toward a center location of the panel portion;

a further included-angle point provided with said tab element and positioned radially outwardly in a termination thereof closely adjacent, though spaced a short distance radially inwardly of the rim portion and circumferential score line; and means for grasping said tab element after initial rupture by stress concentration of pressure applied to depress said tab element at said first included-angle point for easy initial rupture as well as for lifting said tab element upwardly from said panel portion for rupture of the circumferential score-line, the first included-angle point being defined in a sharper angle for stress concentration than a more blunt angle provided with the further included-angle point.

2. A closure-opening device according to claim 1, wherein reinforcement portions are molded in spaced, paired relationship at opposite ends of said tab score so that said tab element always remains securely attached to said panel portion.

3. A closure-opening device according to claim 2, wherein a middle reduced-width portion with opposite side walls is included with said tab element and said means for grasping has serrated side recesses for engagement thereof by fingers.

4. A closure-opening device according to claim 3, wherein a pair of laterally-outwardly-extending projections are molded integrally with said tab element along side walls of a head portion and for engagement by fingernails after initial rupture so that said tab element springs back to its original position, particularly when finger pressure is released after initial rupture without need for fingers to enter the container.

5. A closure-opening device according to claim 2, wherein said reinforcement portions are a pair of semi-spherical droplets on an underside of said panel portion at opposite ends of said tab score.

6. A closure-opening device according to claim 3, wherein side recesses are substantially parallel arcuately-curved scallops extending vertically on opposite side walls of said middle reduced-width portion of said tab element.

7. A closure-opening device according to claim 6, wherein said first included-angle point is provided with approximately 60° and said further included-angle point is provided with a multiple thereof.

8. A closure-opening device according to claim 7, wherein said further included-angle point is provided with approximately 120°.

9. A closure-opening device according to claim 8, wherein said tab-element is arrow-shaped including a relatively blunt base portion located radially outwardly between said reinforcement portions and a sharp pointed head portion directed radially inwardly toward a center of said panel portion.

10. A closure-opening device according to claim 9, wherein a radial bar is molded extending intermediate the center of said panel portion and said first included-angle point of said arrow-shaped tab element.

11. A closure-opening device according to claim 10, wherein said radial bar is located along an underside of said panel portion to permit center gate plastic molding material injection and the circumferential score-line as well as said tab score are both also located along the underside of said panel portion such that molding material is divided at said first included-angle point with the molding material then being free to flow together and fill the raised-surface, upwardly-extending arrow-shaped tab element.

12. A closure-opening device according to claim 2, wherein said reinforcement portions are beaded droplets molded integrally at opposite ends of said tab score so that said tab element always remains securely attached to the panel portion and a complete tearing-out separation of said arrow-shaped tab element is precluded though free pivotal up-and-down movement of said tab element is possible once the initial rupture of said tab score has occurred, and an adhesive means is provided between the rim portion and the container wall configuration.

13. A closure-opening device according to claim 1, wherein a further raised-surface, upwardly-extending arrow-shaped tab element is provided in a location substantially diametrically opposite to said tab element located substantially radially in the panel portion, said further tab element having an enlarged elliptical base and a further tab score extending completely around said further tab element for removal thereof entirely from the panel portion to have a pour spout opening therein to dispense contents of the container therefrom.

14. A closure-opening device according to claim 13, wherein a pour-spout lip at least partially and peripherally surrounds the pour-spout opening which results after removal of said further tab element.

15. A closure-opening device according to claim 14, wherein said pour-spout lip is in a location intermediate said rim portion and the pour-spout opening.

16. A closure-opening device according to claim 15, wherein said pour-spout lip is arcuate and extends upwardly around a majority of the pour-spout opening.

* * * * *